US008688019B2

(12) United States Patent
Nagata

(10) Patent No.: US 8,688,019 B2
(45) Date of Patent: Apr. 1, 2014

(54) IMAGE FORMING APPARATUS

(75) Inventor: Teppei Nagata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 262 days.

(21) Appl. No.: 13/237,052

(22) Filed: Sep. 20, 2011

(65) Prior Publication Data

US 2012/0087701 A1 Apr. 12, 2012

(30) Foreign Application Priority Data

Oct. 8, 2010 (JP) ..... 2010-228495

(51) Int. Cl.
*G03G 15/20* (2006.01)

(52) U.S. Cl.
USPC ..... 399/322; 399/68; 399/397; 399/406

(58) Field of Classification Search
USPC ..... 399/68, 322, 397, 406
See application file for complete search history.

(56) References Cited

U.S. PATENT DOCUMENTS

| | | | | |
|---|---|---|---|---|
| 4,188,109 | A * | 2/1980 | Idenawa et al. | 399/322 |
| 4,380,385 | A * | 4/1983 | Ozaki et al. | 399/318 |
| 4,693,587 | A * | 9/1987 | Shigenobu et al. | 399/322 |
| 4,789,877 | A * | 12/1988 | Izaki | 399/339 |
| 5,307,133 | A | 4/1994 | Koshimizu et al. | |
| 5,343,279 | A | 8/1994 | Nagata et al. | |
| 6,292,650 | B1 * | 9/2001 | Akiyama | 399/406 |
| 7,558,517 | B2 * | 7/2009 | Shirafuji | 399/302 |
| 2006/0051142 | A1 * | 3/2006 | Naniwa et al. | 399/322 |
| 2011/0123212 | A1 * | 5/2011 | Hasegawa | 399/68 |

FOREIGN PATENT DOCUMENTS

| | | |
|---|---|---|
| JP | 55-026533 A | 2/1980 |
| JP | 63-096684 A | 4/1988 |

OTHER PUBLICATIONS

Official Action, dated Sep. 25, 2012, issued by the Japanese Patent Office, in Japanese Application No. 2010-228495.

* cited by examiner

*Primary Examiner* — Ryan Walsh
(74) *Attorney, Agent, or Firm* — Fitzpatrick, Cella, Harper & Scinto

(57) ABSTRACT

The present invention provides an image forming apparatus capable of appropriately curing curl which is apt to be generated at a fixing-completed sheet.

An intersection angle θ2 between respective axis lines 81*c*, 82*c* of an upper conveying roller 81 and a lower conveying roller 82 in a conveying apparatus 80 is set to be in the opposite direction to an intersection angle θ1 between respective axis lines 50*c* and 51*c* of a fixing roller 50 and a pressure roller 51 in the fixing apparatus 40. Accordingly, curl generated at a sheet S at the time of pressure fixing at the fixing apparatus 40 can be returned into a state before fixing as being appropriately corrected in the opposite direction by the upper conveying roller 81 and the lower conveying roller 82.

4 Claims, 8 Drawing Sheets

IMAGE FORMING APPARATUS

BACKGROUND OF THE INVENTION

1. Field of the Invention

The present invention relates to an image forming apparatus including a fixing apparatus which pressurizes and fixes a toner image transferred to a sheet onto the sheet, more specifically, relates to an image forming apparatus including a structure to correct (i.e., cure) curl of a sheet generated in the fixing apparatus.

2. Description of the Related Art

In general, in a case where an image is printed on a sheet with an image forming apparatus, the sheet to which a toner image is transferred by a transfer medium such as a photosensitive drum and an intermediate transfer belt is conveyed to a fixing apparatus at which the toner image is fixed, and then, is conveyed to a discharge portion.

By the way, there is a fixing apparatus including a pair of rollers including a fixing roller and a pressure roller which is arranged as being faced to the fixing roller in a manner of being pressed thereto. Here, there may be a case where a heat roller and a pressure roller are utilized or a heat belt and a pressure belt are utilized instead of the fixing roller and the pressure roller. In the following, description will be made on a case where the fixing roller and the pressure roller are utilized.

The sheet to which the toner image is transferred is pressed at a nip portion between the fixing roller and the pressure roller, so that the toner image is fixed. In this case, pressing between the fixing roller and the pressure roller is performed by pushing both ends of a pair of the rollers. Accordingly, both the rollers are mutually pressed strongly at both end part ranges. However, the pressing force becomes weak at the center part range. Consequently, there occurs difference in fixing capability of the toner image to the sheet between a sheet portion passing through the center part range and sheet portions passing through the both end part ranges of the pair of rollers.

In order to solve the problem, there is an image forming apparatus having a structure in which shock is eased at the time when a sheet is introduced to a fixing apparatus having a fixing roller and a pressure roller as enabling that both the rollers are mutually pressed with even pressure while axis lines of a pair of rollers are intersected with each other. Since distance between a photosensitive drum and a pressure fixing device is shortened in accordance with downsizing, the image forming apparatus is provided with a structure for avoiding a situation that a front end of a sheet is engaged to the fixing roller of the pressure fixing device in a state that a rear end of the sheet is located at the photosensitive drum (see Japanese Patent Laid-open No. 63-096684).

Here, with the image forming apparatus disclosed in Japanese Patent Application Laid-open No. 63-96684, curl possibly occurs at the sheet to which a toner image is fixed as being pressed between the fixing roller and the pressure roller as entering to a nip portion of the rollers owing to intersection between the axis lines of the pair of rollers. In the following, an example of typical curl occurring in the fixing apparatus will be described with reference to FIG. 8.

That is, in a case where respective axis lines 50*c*, 51*c* of a fixing roller 50 and a pressure roller 51 are intersected at an intersection angle θ1 as illustrated in FIG. 8, a sheet S to which a toner image is fixed is apt to be as follows. For example, upper corner curl (U1, U2) is likely to occur as the front-right end section and rear-left end section being regulated to the fixing roller 50 side. Further, lower corner curl (D1, D2) is likely to occur as the front-left end section and rear-right end section being regulated to the pressure roller 51 side. In short, when both of the rollers 50, 51 of the fixing apparatus are intersected as described above, there appear sections without forming a nip portion at the ends in the longitudinal direction of the rollers 50, 51. Accordingly, it is considered that the curl is generated as a result of regulation against the sheet S to which the toner image is fixed at the front-right end section and rear-left end section thereof being the fixing roller side and the front-left end section and rear-right section being the pressure roller side.

The present invention provides an image forming apparatus capable of appropriately curing curl which is apt to be generated at a fixing-completed sheet by adding a simple structure even in a case where axis lines of a pair of rollers are intersected in a fixing apparatus which pressurizes and fixes a toner image.

SUMMARY OF THE INVENTION

The present invention regards a an image forming apparatus, comprising: a transfer apparatus which transfers a toner image formed at an image forming portion to a sheet; a fixing apparatus which pressurizes and fixes the toner image transferred to the sheet at the transfer apparatus onto the sheet; and a conveying portion which is placed at a downstream of the fixing apparatus in a sheet conveying direction and which conveys the sheet fed out from the fixing apparatus. Here, the fixing apparatus includes first and second pressure rotating members which are supported as being rotatable so that respective axis lines are in parallel to each other in a state of being viewed from the sheet conveying direction and the respective axis lines are intersected at a predetermined intersection angle in a state of being viewed from a direction being perpendicular to the sheet conveying direction. Further, the conveying portion includes first and second conveying rotating members which are supported as being rotatable so that respective axis lines are in parallel to each other in a state of being viewed from a sheet conveying direction and the respective axis lines are intersected at an intersection angle being in the opposite direction to that between the first and second pressure rotating members in a state of being viewed from a direction being perpendicular to the sheet conveying direction.

According to the present invention, since the intersection angle between the respective axis lines of the first and second conveying rotating members is set to be in the opposite direction to the intersection angle between the respective axis lines of the first and second pressure rotating members, curl occurring at the sheet during pressure-fixing at the fixing apparatus can be cured in the opposite direction with the first and second conveying rotating members. Accordingly, the sheet can be set to be in an appropriate state as being returned to a flat shape like before fixing.

Further features of the present invention will become apparent from the following description of exemplary embodiments with reference to the attached drawings.

DESCRIPTION OF THE EMBODIMENTS

Figure 1:
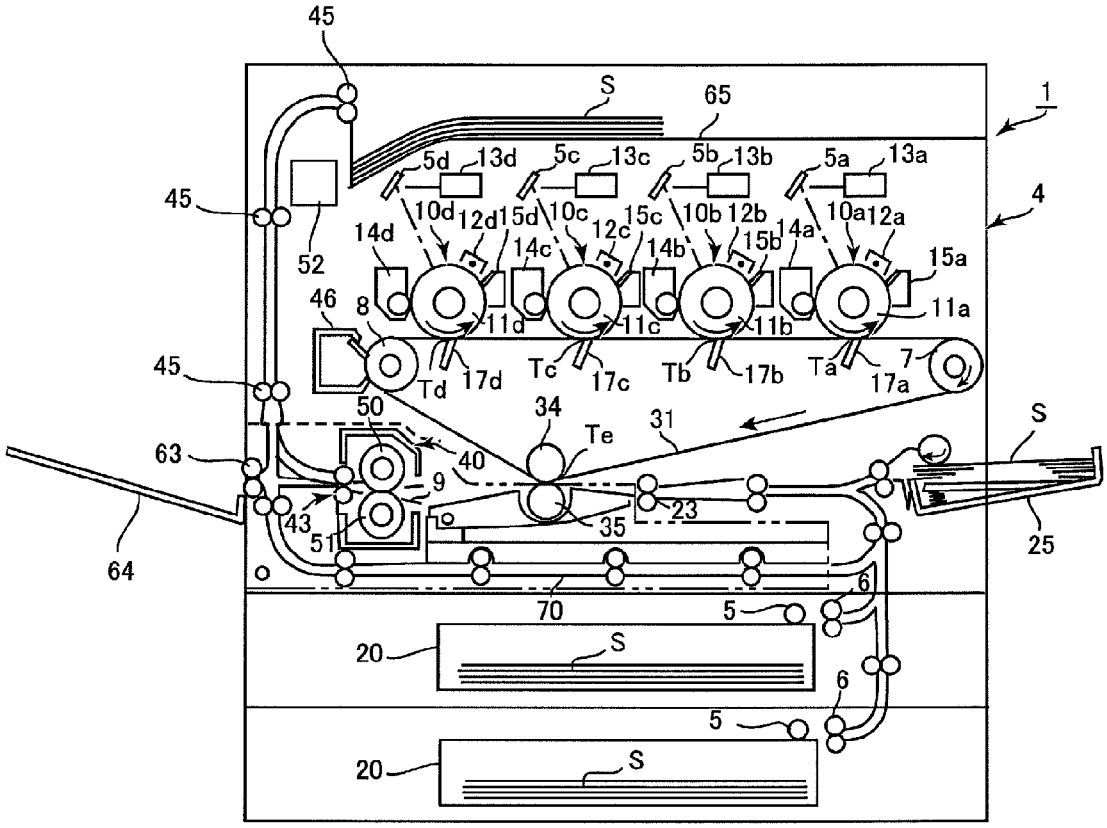
FIG. 1 is a sectional view illustrating an image forming apparatus of the first embodiment according to the present invention.

[First Embodiment] First, a whole structure of an image forming apparatus according to the first embodiment will be described with reference to FIG. 1. FIG. 1 is a sectional view of an image forming apparatus 1 according to the present embodiment such as a color electrophotographic printer as being sectioned along a sheet conveying direction.

As illustrated in FIG. 1, in the image forming apparatus 1, image forming portions 10*d*, 10*c*, 10*b*, 10*a* which form images of yellow, magenta, cyan and black are arranged along an intermediate transfer belt 31 which is arranged at a center part of an apparatus main body. In the image forming portion 10*d* of yellow, a yellow toner image formed on a photosensitive drum 11*d* is primarily transferred to the intermediate transfer belt 31 at a primary transfer portion Td. In the image forming portion 10*c* of magenta, a magenta toner image formed on a photosensitive drum 11*c* is primarily transferred as being superimposed with the yellow toner image on the intermediate transfer belt 31 at a primary transfer portion Tc. Similarly, in the image forming portions 10*b*, 10*a* of cyan and black, a cyan toner image and a black toner image formed respectively on photosensitive drums 11*b*, 11*a* are primarily transferred as being superimposed to a position of the toner images of the intermediate transfer belt 31 sequentially at primary transfer portions Tb, Ta.

The toner images of the four colors borne on the intermediate transfer belt 31 are conveyed to a secondary transfer portion Te and are secondarily transferred at once to a sheet S which is conveyed to be nipped at the secondary transfer portion Te as being overlapped to the intermediate transfer belt 31. The secondary transfer portion Te constitutes a transfer apparatus which transfers the toner images formed at the image forming portions to the sheet S. The sheet S to which the toner images are secondarily transferred at the secondary transfer portion Te has the toner images fixed on the surface thereof as being pressurized at a fixing apparatus 40, and then, is discharged to the outside via an external discharge roller 63. The fixing apparatus 40 pressurizes and fixes the toner images transferred to the sheet S at the transfer apparatus (Te) onto the sheet S. Here, specific examples of the sheet S to which the toner images are formed include plain paper, resin-made sheet-shaped material being substitution of plain paper, thick paper, and material for OHP.

The sheets S are fed to a registration roller 23 one by one from a sheet cassette 20 or a multi-sheet tray 25. The registration roller 23 once receives the sheet S and performs correction of skew feeding to correct to be straight when the sheet S is skewed. The registration roller 23 feeds the sheet S between the intermediate transfer belt 31 and a secondary transfer roller 35 in synchronization with the toner image on the intermediate transfer belt 31. The color toner image on the intermediate transfer belt 31 is transferred to the sheet S by the secondary transfer roller 35 being a transfer body. Subsequently, the toner image on the sheet S is fixed thereto as being pressurized by the fixing apparatus 40.

For example, the sheet S is to be in waiting at the registration roller 23 as being separated to each sheet by a separation roller 6 after being drawn from the sheet cassette 20 by a pick-up roller 5. Then, the sheet S is fed to the secondary transfer portion Te by the registration roller 23 in synchronized timing to the toner image of the intermediate transfer belt 31.

The image forming portions of yellow, magenta, cyan and black are structured to be approximately the same except being different in color of toner to be utilized at attached development apparatuses 14*d*, 14*c*, 14*b*, 14*a* as being respectively yellow, magenta, cyan and black.

In the following, description is made on the image forming portion 10*a* of black. It is to be understood that other image forming portions are described as reading "a" at the end of numerals in the description to be "b", "c", and "d".

The image forming portion 10*a* of black includes a charging apparatus 12*a*, an exposure apparatus (i.e., a laser scanner) 13*a*, a development apparatus 14*a* and a transfer blade 17*a* around a photosensitive drum 11*a* which is rotated in an arrow direction at predetermined processing speed.

The charging apparatus 12*a* charges a surface of the photosensitive drum 11*a* at even negative-polarity potential by irradiating charge particles accompanied by corona discharge to the photosensitive drum 11*a*. The exposure apparatus 13*a* writes an electrostatic image (i.e., a latent image) on the surface of the charged photosensitive drum 11*a* as performing scanning by utilizing a polygon mirror with laser beams ON-OFF-modulated from scanning line image data which is expanded from image data. In the development apparatus 14*a*, negatively-charged toner is borne to a development sleeve and is frictionally slid onto the photosensitive drum 11*a*. Then, vibrating voltage having alternate voltage superimposed to negative-polarity direct voltage is applied to the development sleeve. In this manner, the electrostatic image on the photosensitive drum 11*a* is inversely developed.

The transfer blade 17*a* forms a primary transfer portion Ta between the intermediate transfer belt 31 and the photosensitive drum 11*a* as pressing to the photosensitive drum 11*a* via the intermediate transfer belt 31. The toner image borne to the photosensitive drum 11*a* as being negatively-charged is primarily transferred to the intermediate transfer belt 31 by applying positive-polarity direct voltage to the transfer blade 17*a*. The secondary transfer roller 35 is pressed to a counter roller 34 via the intermediate transfer belt 31, so that the secondary transfer portion Te is formed between the intermediate transfer belt 31 and the secondary transfer roller 35. The sheet S is nipped and conveyed by the secondary transfer portion Te as being overlapped with the toner image of the intermediate transfer belt 31. The toner image borne to the intermediate transfer belt 31 as being negatively-charged is secondarily transferred to the sheet S by applying positive-polarity voltage to the secondary transfer roller 35.

In an intermediate transfer unit, the intermediate transfer belt 31 is supported as being routed around a drive roller 7, a tension roller 8 and the counter roller 34. The intermediate transfer belt 31 is formed of polyethylene terephthalate (PET) or polyvinylidene fluoride (PVDF), for example. The drive roller 7 has rubber having thickness of several millimeters formed of urethane or chloroprene coated on a surface of a metal roller to prevent slipping and is rotationally driven by a pulse motor (not illustrated). The tension roller 8 is configured to apply appropriate tension force to the intermediate transfer belt 31.

The fixing apparatus 40 includes a fixing roller 50, a pressure roller 51 having the same structure, and a conveying guide 9 which guides the sheet S to a nip portion of a pair of the above rollers. The fixing-completed sheet S discharged from the above pair of rollers of the fixing apparatus 40 is further discharged to the outside of the apparatus by an internal discharge roller 43 and the external discharge roller 63. A discharge conveying pass roller 45 is utilized when fixing-completed sheet S is to be discharged to a discharge tray 65 at an upper part of the apparatus.

In the present embodiment, not illustrated in FIG. 1 for convenience sake, a conveying apparatus (conveying portion) 80 (see FIG. 4) which conveys the sheet fed from the fixing apparatus 40 downstream (i.e., to the discharge tray 64 and the like) as being placed at the downstream from the fixing apparatus 40 in the sheet conveying direction is actually arranged instead of the innernal discharge roller 43. Actually, the conveying apparatus 80 is placed at the discharge tray 64 side from the position of the internal discharge roller 43 at a position between the fixing apparatus 40 and the external discharge roller 63 being further from the fixing apparatus 40.

As described later, a controlling portion 52 (see FIG. 3 as well) arranged in the apparatus main body includes a controlling substrate to control operation of mechanism in each unit of the image forming apparatus 1 and a motor drive substrate.

Cleaning apparatuses 15*d*, 15*c*, 15*b*, 15*a* are respectively arranged at the downstream of the first transfer portions Td, Tc, Tb, and Ta of the photosensitive drums 11*d*, 11*c*, 11*b*, and 11*a*. In the cleaning apparatus 15*a*, a cleaning blade is frictionally slid to the photosensitive drum 1*a*, so that disposal particles (i.e., disposal toner) such as transfer-remaining toner, paper powder, and external additive agent being stuck to the surface of the photosensitive drum 1*a* which passes through the first transfer portion Ta is removed and collected. Further, a belt cleaning apparatus 46 which performs cleaning of an image forming face of the intermediate transfer belt 31 is arranged at the downstream of intermediate transfer belt 31 from the secondary transfer portion Te. Here, a duplex path 70 is illustrated in FIG. 1.

Figure 2A:
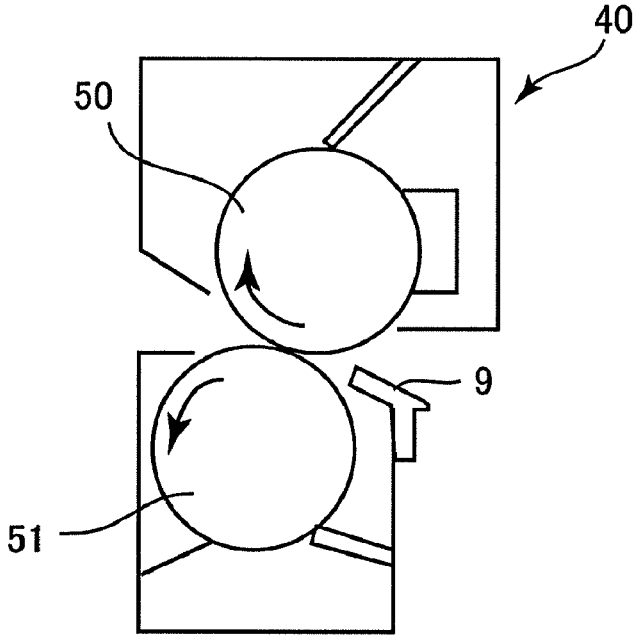
FIG. 2A is a sectional view illustrating a fixing apparatus of the first embodiment.
Figure 2B:
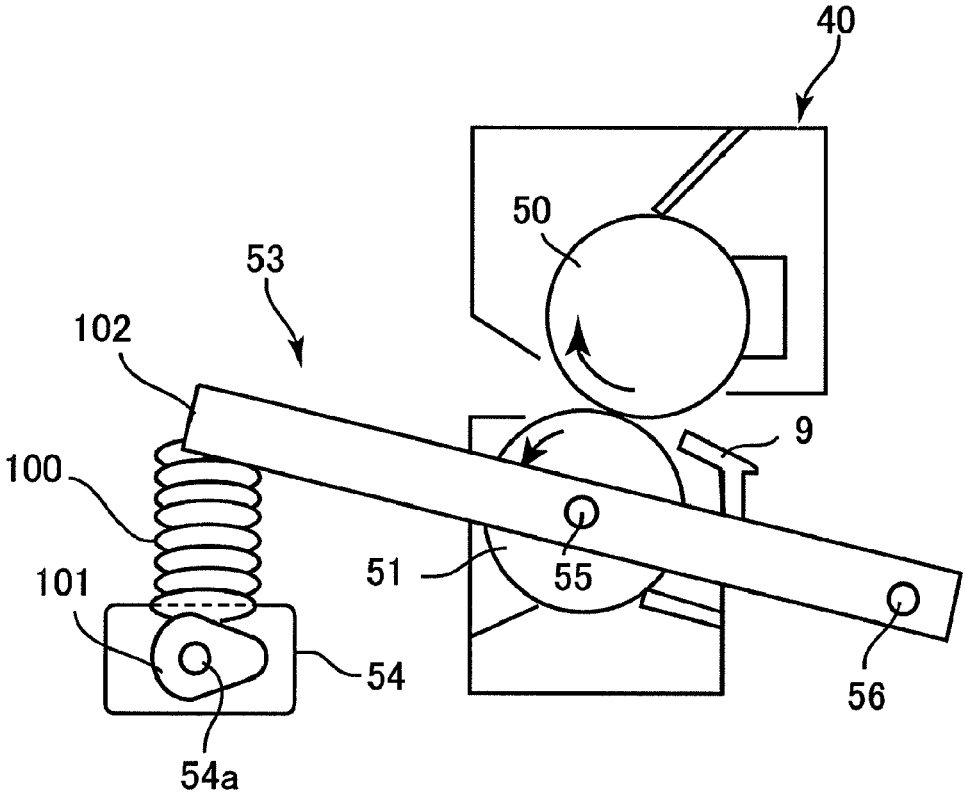
FIG. 2B is a sectional view illustrating a pressurizing mechanism of the fixing apparatus.
Figure 3:
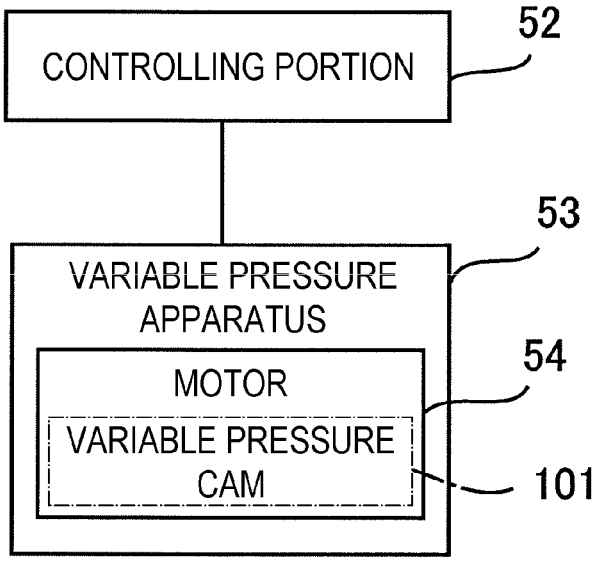
FIG. 3 is a control block diagram for control of a pressurizing mechanism (i.e., a variable pressure apparatus) of the fixing apparatus of the first embodiment.
Figure 4:
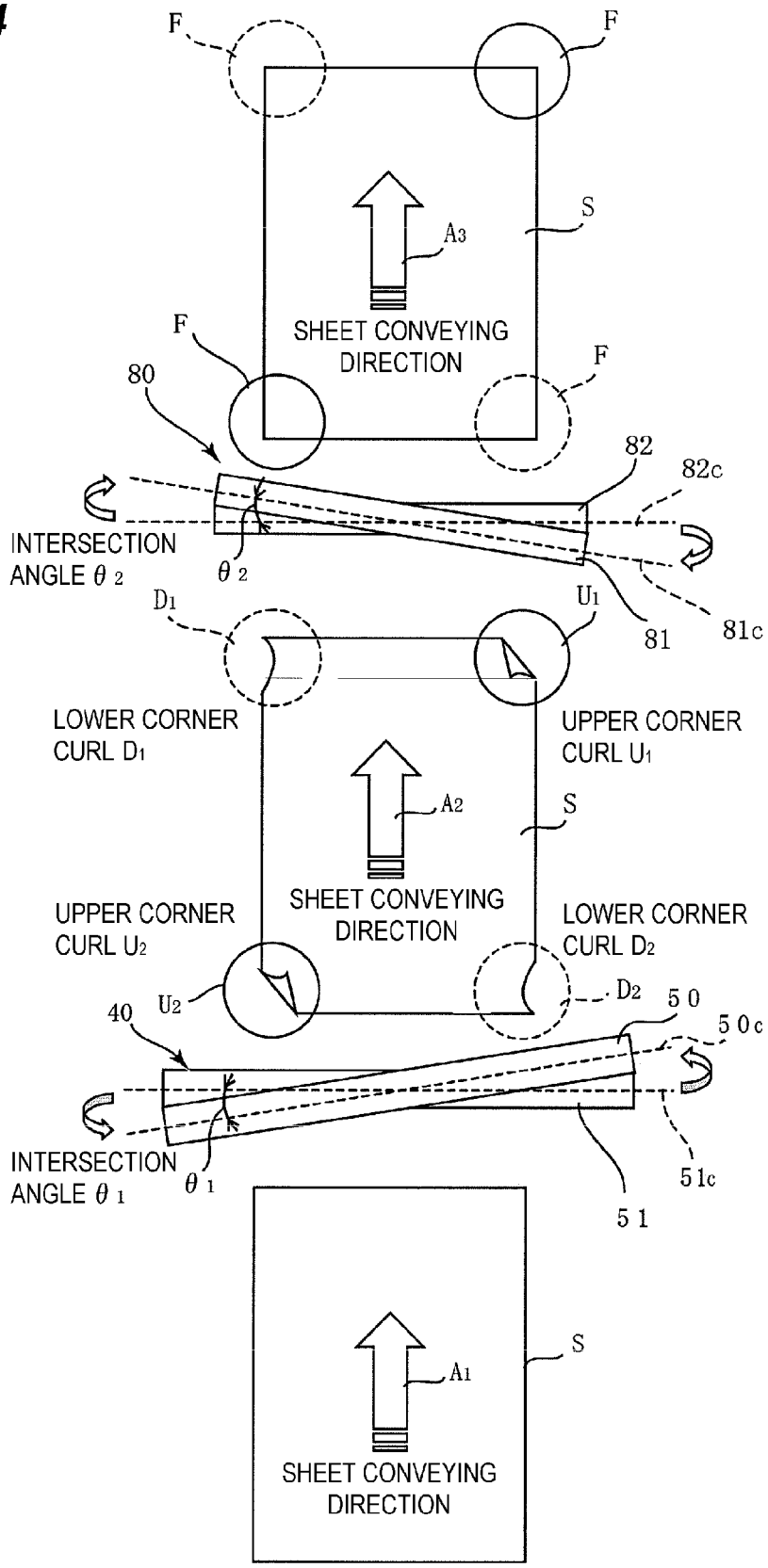
FIG. 4 is a plane view schematically illustrating the fixing apparatus and the conveying apparatus of the first embodiment and an example of curl occurring in the fixing apparatus.

Next, the fixing apparatus 40 and the conveying apparatus 80 according to the present embodiment are described in detail with reference to FIGS. 2A to 4. FIG. 2A is a sectional view illustrating the fixing apparatus 40 of the present embodiment. FIG. 2B is a sectional view illustrating about a pressurizing mechanism (i.e., a variable pressure apparatus) of the fixing apparatus 40. FIG. 3 is a control block diagram for control of a variable pressure apparatus 53 of the fixing apparatus 40 of the first embodiment. FIG. 4 is a plane view schematically illustrating the fixing apparatus of the present embodiment and an example of curl occurring in the fixing apparatus.

As illustrated in FIG. 2A, the fixing apparatus 40 is configured such that the fixing roller 50 and the pressure roller 51 having the same structure are pressed with predetermined load. The fixing roller 50 can be prepared by performing hard chrome plating of which film thickness is between 4 to 9 μm onto a steel-made roller which is high-frequency hardened having outer diameter of about 33 mm, for example.

As illustrated in FIG. 4, the fixing apparatus 40 is structured as follows. That is, both the rollers 50, 51 are supported as being rotatable so that respective axis lines 50*c*, 51*c* are in parallel to each other in a state of being viewed from the sheet conveying direction A1 and the respective axis lines 50*c*, 51*c* are intersected at an intersection angle θ1 in a state of being viewed from a sheet thickness direction being perpendicular to the sheet conveying direction A1. As described above, the intersecting angle between the axis lines 50*c*, 51*c* is defined as the intersection angle θ1 (i.e., a predetermined angle). Here, the fixing roller 50 and the pressure roller 51 respectively constitute a first pressure rotating member and a second pressure rotating member (i.e., a pair of upstream pressure rotating members).

That is, the pressure roller 51 located at the lower side is rotatably supported by the apparatus main body as the axis line 51*c* is extended in the width direction being perpendicular to the sheet conveying direction A1. The fixing roller 50 located at the upper side is rotatably supported by the apparatus main body so as to be in an intersected state at about 2 degrees, for example, against the axis line 51*c* of the pressure roller 51. The pressure roller 51 is pressed to the fixing roller 50 by the variable pressure apparatus 53 which is operated under control of the controlling portion 52, for example, with line pressure of 20 kgf/cm and total pressure of 700 to 1000 kgf.

The variable pressure apparatus 53 which presses the pressure roller 51 to the fixing roller 50 is structured as illustrated in FIG. 2B. That is, the variable pressure apparatus 53 includes a lever member 102 (illustrating only a front side for convenience sake) which supports both ends of a rotating shaft 55 extended in the width direction (i.e., a front-back direction in FIG. 2B) being perpendicular to the sheet conveying direction (i.e., a right-left direction in FIG. 2B). One end of the lever member 102 is rotatably supported by the apparatus main body with a rotating shaft 56, a center part thereof is rotatably supported by the pressure roller 51 with the rotating shaft 55, and the other end thereof is contacted to an upper end of a pressure spring 100. Elasticity of the pressure spring 100 is varied with rotation of a variable pressure cam 101 in the above state so as to control a pressure state of the pressure roller 51 against the fixing roller 50.

A motor 54 located at the lower side of the other end of the lever member 102 has a housing fixedly supported by the apparatus main body. The variable pressure cam 101 is fixed to a distal end of a rotating shaft 54*a* of the motor 54. The pressure spring 100 is a compression spring arranged as being compressed between the other end of the lever member 102 and the variable pressure cam 101 and is supported by the apparatus main body via a support member (not illustrated) so as to be extensible. In the variable pressure apparatus 53 having the above structure, the variable pressure cam 101 is rotated at slow speed under control of the controlling portion 52. With the above structure, the variable pressure cam 101 pushes up the pressure spring 100 against the fixing roller 50 which is rotatably supported by the apparatus main body, so that pressing force is varied as the pressure roller 51 presses the fixing roller 50 with rotation of the lever member 102.

Further, as illustrated in FIG. 4, the conveying apparatus 80 is arranged at the downstream side of the fixing apparatus 40. An upper conveying roller 81 and a lower conveying roller 82 of the conveying apparatus 80 are arranged so that respective axis lines 81*c*, 82*c* are in parallel to each other in a state of being viewed from the sheet conveying direction A2. Further, the upper conveying roller 81 and the lower conveying roller 82 are supported as being rotatable so that the respective axis lines 81*c*, 82*c* are intersected at an intersection angle θ2 which is in the opposite direction to that between the above rollers 50, 51 in a state of being viewed from a sheet thickness direction perpendicular to the sheet conveying direction A2. As described above, the intersecting angle between the axis lines 81*c*, 82*c* is defined as the intersection angle θ2. Here, the upper conveying roller 81 and the lower conveying roller 82 respectively constitute a first conveying rotating member and a second conveying rotating member (i.e. a pair of downstream pressure rotating members).

The intersection angle θ2 at which the respective axis lines 81*c*, 82*c* of the upper conveying roller 81 and the lower conveying roller 82 are intersected is set to be in the opposite direction to the intersection angle θ1 at which the respective axis lines 50*c*, 51*c* of the fixing roller 50 and the pressure roller 51 are intersected. With this structure, the sheet S passing through the conveying apparatus 80 is regulated at the front-right end section and the rear-left end section thereof to be the lower conveying roller 82 side and is regulated at the front-left end section and the rear-right end section thereof to be the upper conveying roller 81 side. That is, since force in the opposite direction to a direction of force forming curl within the fixing apparatus 40 is exerted to the sheet S, the curl (i.e., U1, U2, D1 and D2) generated in the fixing apparatus 40 is cured (i.e., corrected) as indicated by a character F. Accordingly, the sheet S is returned to a flat shape like before fixing.

Next, a control block diagram for control of the variable pressure apparatus 53 will be described with reference to FIG. 3. As illustrated in FIG. 3, the motor 54 of the variable pressure apparatus 53 is electrically connected to the controlling portion 52 which is disposed in the apparatus main body (see FIG. 1). The variable pressure cam 101 is rotated at low speed caused by rotational driving of the motor 54 under control of the controlling portion 52.

The controlling portion 52 controls driving time of the motor 54 so that desired pressing force to press the pressure roller 51 to the fixing roller 50 is obtained at a previously-determined rotational position of the variable pressure cam 101. Here, it is possible to confirm whether or not the desired pressing force is obtained by detecting the rotational angle of the variable pressure cam 101. It is also possible by detecting length of the pressure spring 100.

By the way, in a case where the fixing roller 50 and the pressure roller 51 are simply arranged in parallel without intersecting between the axis lines 50*c*, 51*c*, each center part of the rollers 50, 51 are bent as the fixing roller 50 and the pressure roller 51 being relatively pressed. Accordingly, both the rollers 50, 51 are mutually pressed strongly at both end part ranges. However, the pressing force becomes relatively weak at the center part range. Consequently, there occurs difference in fixing capability of the toner image to the sheet between a sheet portion passing through the center part range and sheet portions passing through the both end part ranges of the rollers 50, 51.

To solve such a problem, in the present embodiment, the fixing roller 50 and the pressure roller 51 are configured to be mutually pressed with approximately even pressure by mutually intersecting the respective axis lines 50*c*, 51*c* as described above. Here, the mutual intersection between the axis lines 50*c*, 51*c* of the fixing roller 50 and the pressure roller 51 causes a fear that curl is generated at the sheet S to which the toner image is fixed with pressure as being introduced to the nip portion of the rollers 50, 51.

Here, an example of the curl generated in the fixing apparatus 40 will be described with reference to FIG. 4. That is, when the sheet S passes through the fixing apparatus 40, the curl occurs at corner sections of the sheet S. Shapes thereof are different respectively at the front end, the rear end, the left end and the right end of the sheet S. Since the fixing roller 50 and the pressure roller 51 are intersected as described in FIG. 4, there appear sections without forming a nip portion at the ends in the longitudinal direction of the rollers 50, 51. That is, when passing through the nip portion, the sheet S to which the toner image is fixed is likely to generate curl (i.e., U1 and U2) at the front-right end section and rear-left end section as being regulated to the fixing roller 50 side at the upper part. Further, it is considered that curl is apt to be generated at the front-left end section and the rear-right end section as being regulated to the pressure roller 51 side at the lower part.

To solve such a problem, in the present embodiment, the abovementioned conveying apparatus 80 is arranged at the downstream of the fixing apparatus 40 in the sheet conveying direction. In many cases, the upper conveying roller 81 and the lower conveying roller 82 of the conveying apparatus 80 are pressed, for example, with line pressure of 1 kgf/cm and total pressure of 35 to 50 kgf as being smaller than pressing force between the fixing roller 50 and the pressure roller 51. Accordingly, the upper conveying roller 81 and the lower conveying roller 82 are to be in a state that the axis lines 81*c*, 82*c* are intersected at about 30 to 40 degrees, for example, as being set to be larger than the intersection angle θ1 (e.g., 2 degrees) formed between the fixing roller 50 and the pressure roller 51. The above structure causes an action to cure the curl to be larger and more effective.

In FIG. 4, the sheet conveying direction A1 indicates the direction before the sheet is introduced to the fixing apparatus 40. The sheet conveying direction A2 indicates the direction of proceeding (i.e., skew feeding) as being slightly shifted to the left side caused by the intersection angle θ1 when passing through the fixing apparatus 40. Further, the sheet conveying direction A3 indicates the direction of being returned to the initial sheet conveying direction A1 (i.e., skew feeding correction) as being slightly shifted to the right side caused by the intersection angle θ2 when passing through the conveying apparatus 80. That is, in the present embodiment, the sheet S is fed out from the fixing apparatus 40 in a state of being slid slightly to the left side of FIG. 4 in relation to the intersection angle θ1 between the fixing roller 50 and the pressure roller 51. However, since the upper conveying roller 81 and the lower conveying roller 82 of the conveying apparatus 80 forms the intersection angle θ2 which is opposite to the intersection angle θ1, the sheet S is fed out in a state of being slid slightly to the right side of FIG. 4. Accordingly, the center position during conveyance can be returned to the initial sheet conveying direction A1.

According to the present embodiment, a following effect can be obtained by adding a simple structure that the intersection angle θ2 between the respective axis lines 81*c*, 82*c* of the upper conveying roller 81 and the lower conveying roller 82 is set to be in the opposite direction to the intersection angle θ1 between the respective axis lines 50*c*, 51*c* of the fixing roller 50 and the pressure roller 51. That is, the curl generated at the sheet S at the time of pressure fixing at the fixing apparatus 40 can be returned into a state before fixing as being appropriately corrected in the opposite direction by the upper conveying roller 81 and the lower conveying roller 82.

Figure 5:
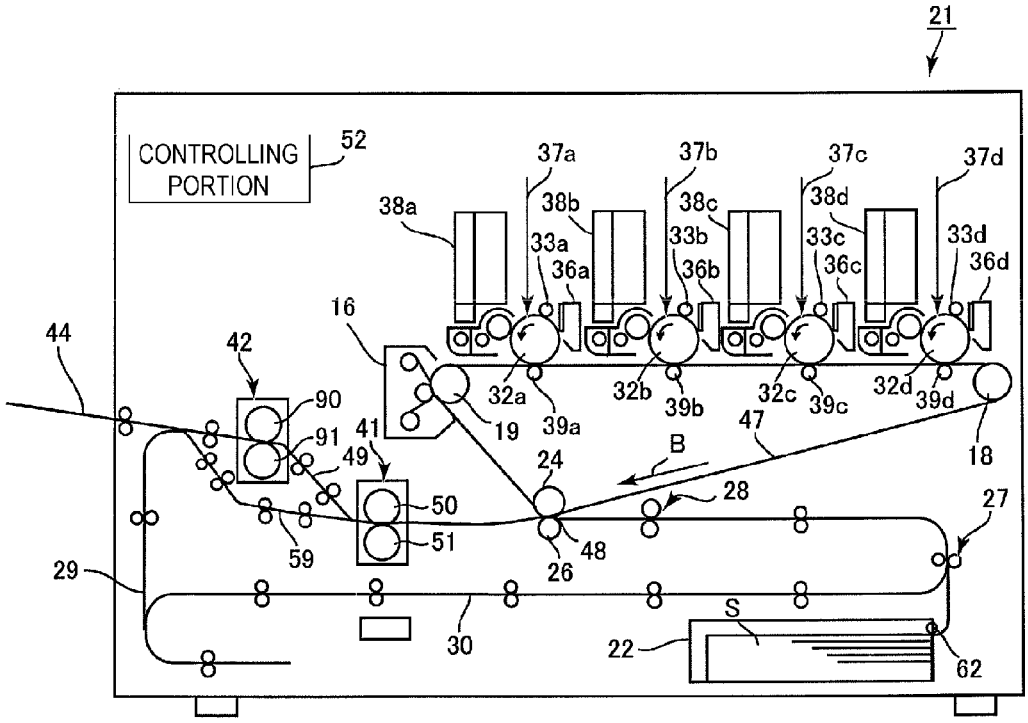
FIG. 5 is a sectional view illustrating an image forming apparatus of the second embodiment according to the present invention.

[Second Embodiment] Next, the second embodiment according to the present invention will be described with reference to FIGS. 5 to 7. First, a whole structure of an image forming apparatus 21 according to the present embodiment will be described with reference to FIG. 5. FIG. 5 is a sectional view schematically illustrating the whole structure of the image forming apparatus 21.

In the image forming apparatus 21, laser is irradiated respectively from laser scanning units 37*a*, 37*b*, 37*c*, 37*d* of which light source is semiconductor laser onto surfaces of photosensitive drums 32*a*, 32*b*, 32*c*, 32*d* of respective colors of yellow, magenta, cyan and black. With this structure, an electrostatic latent image is formed on each surface of the photosensitive drums 32*a* to 32*d*. From the respective electrostatic latent images formed at the photosensitive drums 32*a* to 32*d*, toner images are produced as the electrostatic latent images are developed respectively by development units 38*a* to 38*d*. The toner images of the respective colors are sequentially superimposed onto an intermediate transfer belt 47 by primary transfer portions 39*a* to 39*d*.

The intermediate transfer belt 47 is rotated in a direction of arrow B in a state of being supported by rollers 18, 19, 24. Accordingly, the toner images of the respective colors superimposed on the intermediate transfer belt 47 are conveyed to a secondary transfer portion 48, and then, are transferred at once to a sheet S which is to be conveyed to the secondary transfer portion 48 as a four-color toner image (i.e., a non-fixed toner image).

FIG. 5 illustrates chargers 33*a* to 33*d* which evenly charge surfaces of the photosensitive drums 32*a* to 32*d*, cleaners 36*a* to 36*d* which respectively remove toner remaining on the surfaces of the photosensitive drums 32*a* to 32*d*, and a cleaner 16 which removes toner remaining at the intermediate transfer belt 47. In the present embodiment, there is provided an image forming portion to form an image which includes the photosensitive drums 32*a* to 32*d*, the laser scanning units 37*a* to 37*d* and the development units 38*a* to 38*d*.

After being fed from a sheet cassette 22 to a conveying path, the sheet S is conveyed to the secondary transfer portion 48 which includes a rotating roller 24 and a secondary transfer roller 26 as being synchronized to registration timing at a registration roller 28. Then, the sheet S to which the four-color toner images are transferred all together at the secondary transfer portion 48 is conveyed to a first fixing apparatus 41 and the non-fixed toner image is pressurized and fixed. Subsequently, the sheet S is discharged to a discharge tray 44 via a conveying path 59 or is discharged to the discharge tray 44 after high glossiness is added at a second fixing apparatus 42 via a conveying path 49.

In the present embodiment, the secondary transfer portion 48 constitutes a transfer apparatus which transfers a toner image formed at the image forming portion to the sheet S. The first fixing apparatus 41 has a structure to pressurize and fix the toner image which is transferred to the sheet S at the secondary transfer portion 48 onto the sheet S. Here, FIG. 5 illustrates a vertical path roller 27 and a pick-up roller 62. In the image forming apparatus 21 as well, a controlling portion 52 being approximately similar to the above is arranged in the apparatus main body.

In the image forming apparatus 21, the second fixing apparatus 41 is arranged at the downstream of the first fixing apparatus 40 in the sheet conveying direction mainly so as to perform image output with high glossiness. Since the fixing apparatuses 41, 42 are aligned in series at a conveying path of the sheet S, greater latitude can be obtained for heat quantity and pressing force to the toner image having influence to gloss. Accordingly, image output can be made in a wide range of glossiness.

In the present embodiment, the first fixing apparatus 41 being a fixing apparatus has the similar apparatus structure to the fixing apparatus 40 of the first embodiment. The second fixing apparatus 42 being a conveying apparatus is similar to the conveying apparatus 80 of the first embodiment in the point that the sheet fed out from the first fixing apparatus 41 downstream is conveyed in the conveying direction. A fixing roller 90 and a pressure roller 91 of the second fixing apparatus 42 serve as the first and second conveying rotating members (i.e., the pair of downstream pressure rotating member) as well as pressure rotating members which pressurizes and conveys the sheet as being mutually pressed.

Further, at the time of duplex printing, the sheet S passing through the first fixing apparatus 41 and the second fixing apparatus 42 (alternatively, only the first fixing apparatus 41) is conveyed to a duplex path 30 as being inversely conveyed in the opposite direction after being introduced to a duplex inversion path 29. Similarly to the above, the sheet S passing through the duplex path 30 passes the vertical path roller 27 once again and is conveyed to the secondary transfer portion 48. The toner images of the respective colors are transferred all together from the intermediate transfer belt 47 to the rear surface of the sheet S which is conveyed to the secondary transfer portion 48. The transfer-completed sheet S is discharged to the discharge tray 44 via the first fixing apparatus 41 and the second fixing apparatus 42 (alternatively, only the first fixing apparatus 41).

Next, the first fixing apparatus 41 and the second fixing apparatus 42 according to the present embodiment will be described with reference to FIGS. 6 and 7. FIG. 6 is a sectional view illustrating the second fixing apparatus 42 of the present embodiment. FIG. 7 is a plane view schematically illustrating the first and second fixing apparatuses 41, 42 of the present embodiment and an example of curl occurring in the first fixing apparatus 41.

Figure 7:
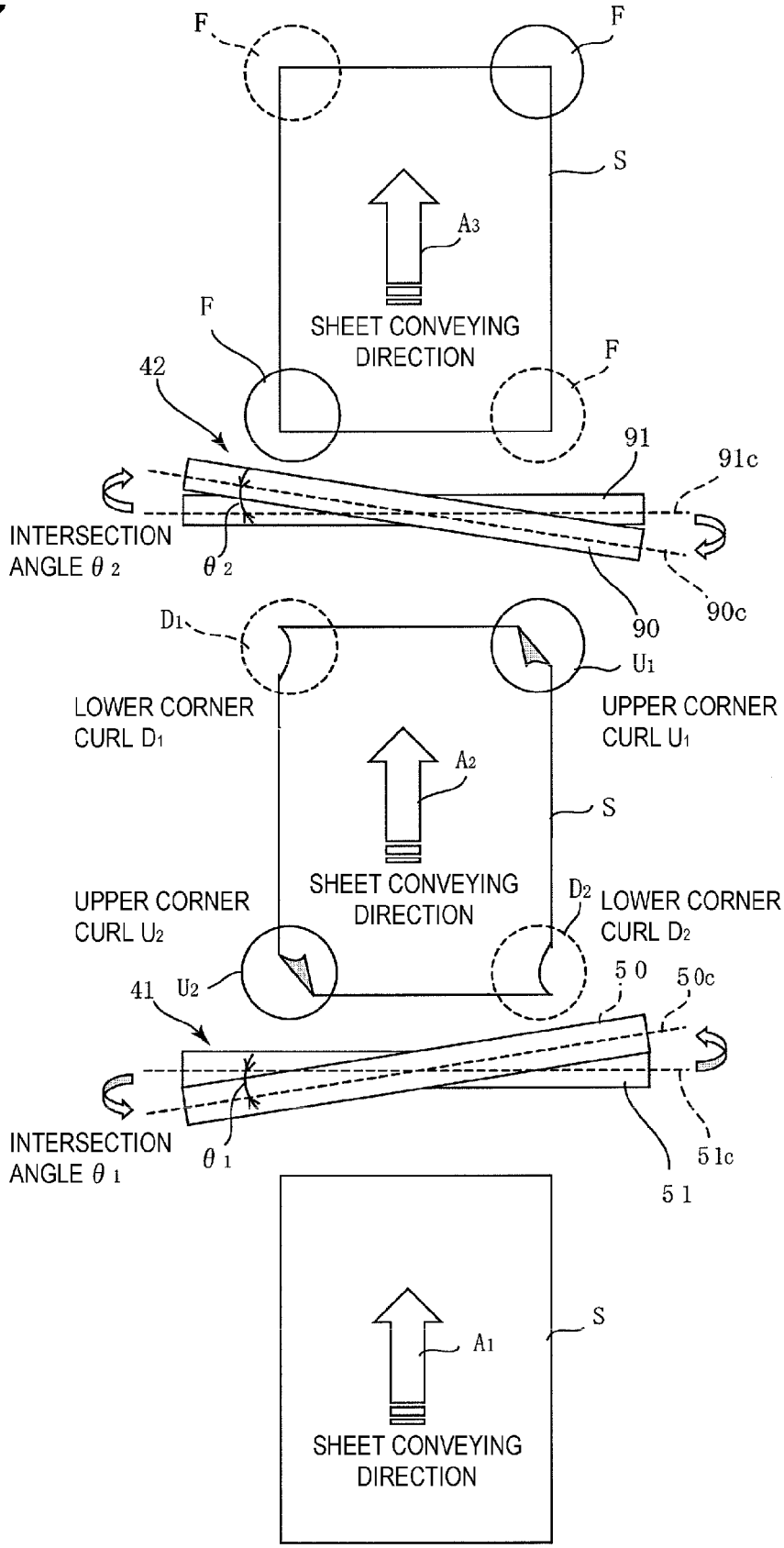
FIG. 7 is a plane view schematically illustrating the first and second fixing apparatus of the second embodiment and an example of curl occurring in the first fixing apparatus.
Figure 8:
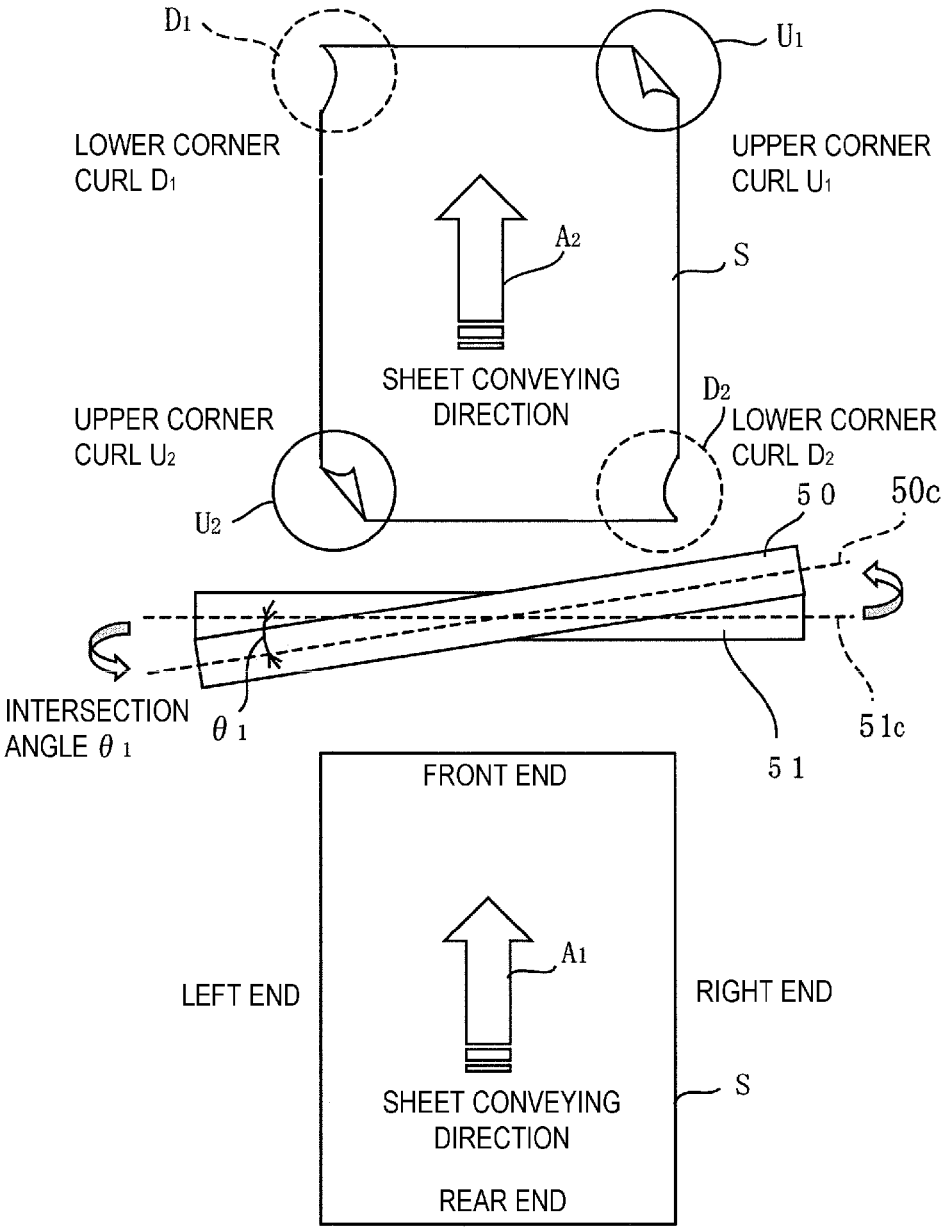
FIG. 8 PRIOR ART
FIG. 8 is a plane view schematically illustrating an example of curl occurring in a fixing apparatus in the related art.

The first fixing apparatus 41 illustrated in FIG. 7 has the same structure as the fixing apparatus 40 illustrated in FIGS. 2A and 2B. In the structure, the fixing roller 50 and the pressure roller 51 are pressed with a predetermined load. The second fixing apparatus 42 illustrated in FIG. 7 has the same structure as the first fixing apparatus 41 (that is, the fixing apparatus 40). In the structure, the fixing roller 90 and the pressure roller 91 are pressed with predetermined load.

Figure 6:
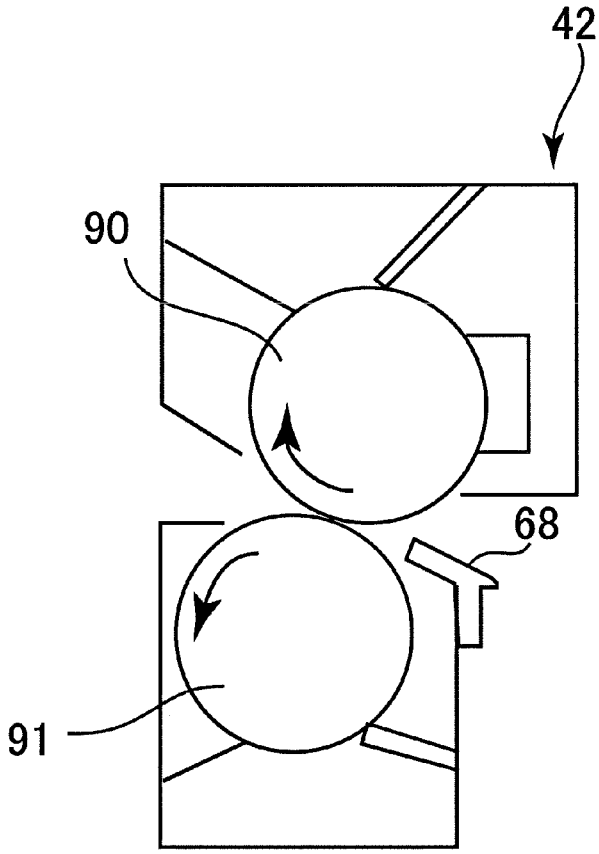
FIG. 6 is a sectional view illustrating a second fixing apparatus of the second embodiment.

As illustrated in FIG. 6, the second fixing apparatus 42 having the same structure as the first fixing apparatus 41 includes a conveying guide 68 which guides the sheet S to a nip portion of the fixing roller 90 and the pressure roller 91. The fixing roller 50 and the fixing roller 90 having the same structure can be prepared by performing hard chrome plating of which film thickness is between 4 to 9 μm respectively onto a steel-made roller which is high-frequency hardened having outer diameter of about 33 mm, for example.

The pressure rollers 51, 91 located respectively at the lower side of the fixing rollers 50, 90 are rotatably supported by the apparatus main body as the axis lines 51*c*, 91*c* are extended in the width direction being perpendicular to the sheet conveying direction A1. The fixing rollers 50, 90 at the upper side are rotatably supported by the apparatus main body so as to be in an intersected state at an intersection angle θ1 (e.g., 2 degrees) respectively against the axis lines 51*c*, 91*c* of the pressure rollers 51, 91. The pressure rollers 51, 91 at the lower side are pressed respectively to the fixing rollers 50, 90 by the variable pressure apparatus 53 (see FIG. 3) which is operated under control of the controlling portion 52 (see FIGS. 3 and 5), for example, with line pressure of 20 kgf/cm and total pressure of 700 to 1000 kgf.

As illustrated in FIG. 7, the fixing roller 50 and the pressure roller 51 of the first fixing apparatus 41 are arranged so that the respective axis lines 50*c*, 51*c* are in parallel to each other in a state of being viewed from the sheet conveying direction A1. Further, the fixing roller 50 and the pressure roller 51 are supported as being rotatable so that the respective axis lines 50*c*, 51*c* are intersected at an intersection angle θ1 (i.e., a predetermined angle) in a state of being viewed from a sheet thickness direction being perpendicular to the sheet conveying direction A1. The fixing roller 50 and the pressure roller 51 respectively constitute the first pressure rotating member and the second pressure rotating member.

Further, the second fixing apparatus 42 is arranged at the downstream of the first fixing apparatus 41 in the sheet conveying direction and serve as the conveying apparatus which conveys the sheet S fed out from the first fixing apparatus 41. The fixing roller 90 and the pressure roller 91 of the second fixing apparatus 42 are arranged so that the respective axis lines 90*c*, 91*c* are in parallel to each other in a state of being viewed from the sheet conveying direction A2. Further, the fixing roller 90 and the pressure roller 91 are supported as being rotatable so that the respective axis lines 90*c*, 91*c* are intersected at an intersection angle θ2 which is in the opposite direction to that between the fixing roller 50 and the pressure roller 51 in a state of being viewed from a sheet thickness direction being perpendicular to the sheet conveying direction A2. The fixing roller 90 and the pressure roller 91 respectively constitute the first conveying rotating member and the second conveying rotating member as well as the pressure rotating member.

In the present embodiment, the above description exemplifies that both the intersection angle θ1 between the fixing roller 50 and the pressure roller 51 of the first fixing apparatus 41 and the intersection angle θ2 between the fixing roller 90 and the pressure roller 91 of the second fixing apparatus 42 are 2 degrees, respectively. Here, the sheet conveyed to the second fixing apparatus 42 is in a state that curl is easily corrected as being previously heated at the time of passing through the first fixing apparatus 41. Accordingly, the similar curl curing effect can be obtained even when the intersection angle θ2 of the second fixing apparatus 52 is set to be smaller than the intersection angle θ1 of the first fixing apparatus 41.

According to the present embodiment, a following effect can be obtained by adding a simple structure that the intersection angle θ2 between the respective axis lines 90*c*, 91*c* of the fixing roller 90 and the pressure roller 91 is set to be in the opposite direction to the intersection angle θ1 between the respective axis lines 50*c*, 51*c* of the fixing roller 50 and the pressure roller 51. That is, the curl generated at the sheet S at the time of pressure fixing at the first fixing apparatus 41 can be returned into a state before fixing as being appropriately corrected in the opposite direction by the fixing roller 90 and the pressure roller 91.

In the above first and second embodiments, description has been made on the fixing apparatuses (40, 41, 42) in which both the fixing member and the pressure member are formed of rollers. However, the present invention is not limited to this, but can be applied to a fixing apparatus in which either member includes a belt. Further, in the second embodiment, the variable pressure apparatus 53 is attached to the pressure roller 91 serving as the second conveying rotating member. However, it is also possible to adopt a structure in which the pressure apparatus 53 is attached to the fixing roller 90 serving as the first conveying rotating member. Here, the above-mentioned examples are described in detail only for exemplifying exemplary embodiments of the present invention. Accordingly, dimensions, materials, shapes, relative arrangement thereof, and the like are not intended to limit the scope of the present invention thereto.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-228495, filed Oct. 8, 2010, which is hereby incorporated by reference herein in its entirety.

What is claimed is:

1. An image forming apparatus, comprising:

a transfer apparatus which transfers a toner image formed at an image forming portion to a sheet;

a fixing apparatus which pressurizes and fixes the toner image transferred to the sheet at the transfer apparatus onto the sheet; and a conveying portion which is placed downstream of the fixing apparatus in a sheet conveying direction and which conveys the sheet fed out from the fixing apparatus, wherein the fixing apparatus includes first and second pressure rotating members which are rotatable supported so that respective axis lines are in parallel to each other in a state of being viewed from the sheet conveying direction and the respective axis lines are intersected at a predetermined intersection angle in a state of being viewed from a direction perpendicular to the sheet conveying direction, and the conveying portion includes first and second conveying rotating members which are rotatable supported so that respective axis lines are in parallel to each other in a state of being viewed from a sheet conveying direction and the respective axis lines are intersected at an intersection angle being in the opposite direction to that between the first and second pressure rotating members in a state of being viewed from a direction perpendicular to the sheet conveying direction.

2. The image forming apparatus according to claim 1, wherein the first and second conveying rotating members of the conveying portion are pressure rotating members being mutually pressed to pressurize and convey the sheet.

3. The image forming apparatus according to claim 2, further comprising a variable pressure apparatus which is attached to one end of the first conveying rotating member or the second conveying rotating member.

4. The image forming apparatus according to claim 3, wherein the variable pressure apparatus includes a lever member which supports one end of the first conveying rotating member or the second conveying rotating member, a rotating shaft which supports one end of the lever member, and a variable pressure cam which lifts and lowers the other end of the lever member.

* * * * *